US009505224B2

(12) United States Patent
Kimura et al.

(10) Patent No.: US 9,505,224 B2
(45) Date of Patent: Nov. 29, 2016

(54) RECORDING APPARATUS

(71) Applicant: SEIKO EPSON CORPORATION, Tokyo (JP)

(72) Inventors: Naomi Kimura, Okaya (JP); Shoma Kudo, Shiojiri (JP); Hidenao Suzuki, Matsumoto (JP); Munehide Kanaya, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/074,888

(22) Filed: Mar. 18, 2016

(65) Prior Publication Data

US 2016/0200111 A1 Jul. 14, 2016

Related U.S. Application Data

(63) Continuation of application No. 14/737,008, filed on Jun. 11, 2015, which is a continuation of application No. 14/593,881, filed on Jan. 9, 2015, which is a continuation of application No. 14/049,086, filed on Oct. 8, 2013.

(30) Foreign Application Priority Data

Oct. 15, 2012 (JP) ..... 2012-227712
Oct. 15, 2012 (JP) ..... 2012-227713

(51) Int. Cl.
*B41J 2/175* (2006.01)
*B41J 2/20* (2006.01)
*B41J 25/00* (2006.01)

(52) U.S. Cl.
CPC ..... *B41J 2/17506* (2013.01); *B41J 2/1752* (2013.01); *B41J 2/17509* (2013.01); *B41J 2/17553* (2013.01); *B41J 2/20* (2013.01); *B41J 25/001* (2013.01)

(58) Field of Classification Search
CPC ..... B41J 2/17506; B41J 2/09; B41J 2/13; B41J 2/23; B41J 2/53; B41J 25/001; B41J 25/304; B41J 29/02; B41J 2/02
See application file for complete search history.

(56) References Cited

U.S. PATENT DOCUMENTS 5,909,226 A 6/1999 Takeda
6,151,051 A 11/2000 Ikeda et al.

(Continued)

FOREIGN PATENT DOCUMENTS

CN 1636750 7/2005
CN 101318414 12/2008

(Continued)

OTHER PUBLICATIONS

U.S. Appl. No. 14/737,008, filed Jun. 11, 2015, Kimura, et al.

(Continued)

*Primary Examiner* — Anh T. N. Vo
(74) *Attorney, Agent, or Firm* — Workman Nydegger

(57) ABSTRACT

A recording apparatus includes a housing body, an opening/closing member, attached to the housing body via a pivot shaft so as to be capable of rotating freely, that covers the surface of the housing body on one side thereof, and an ink tank having an injection port for filling an ink holding chamber with ink used in recording. Here, the ink tank is disposed so that one end thereof is positioned within the housing body on the opposite side of the housing body as the side in which the pivot shaft is provided, and has a stepped shape including a step portion, the step portion being provided on a side of the ink tank that is further from the pivot shaft. The injection port is provided in the step portion, and when the opening/closing member is opened and the ink is to be filled.

10 Claims, 13 Drawing Sheets

(56) References Cited

U.S. PATENT DOCUMENTS

| | | | | |
|---|---|---|---|---|
| 6,179,415 | B1 | 1/2001 | Okazaki et al. | |
| 6,804,858 | B2 | 10/2004 | Yazawa et al. | |
| 7,607,769 | B2 * | 10/2009 | Umeda | B41J 2/1752 347/85 |
| 7,712,891 | B2 | 5/2010 | Ishida et al. | |
| 7,784,893 | B2 * | 8/2010 | Ishida | B41J 29/02 347/16 |
| 7,826,109 | B2 | 11/2010 | Ikeno | |
| 8,057,022 | B2 | 11/2011 | Umeda | |
| 2005/0151782 | A1 | 7/2005 | Ishida et al. | |
| 2006/0082622 | A1 | 4/2006 | Yonekawa et al. | |
| 2008/0030530 | A1 | 2/2008 | Ishida et al. | |
| 2008/0297571 | A1 | 12/2008 | Umeda et al. | |
| 2012/0038719 | A1 | 2/2012 | Shimizu et al. | |
| 2012/0056949 | A1 | 3/2012 | Ishizawa et al. | |
| 2012/0125481 | A1 | 5/2012 | Matsumoto et al. | |
| 2013/0169720 | A1 | 7/2013 | Nakamura et al. | |
| 2014/0104349 | A1 | 4/2014 | Kimura et al. | |
| 2014/0146113 | A1 | 5/2014 | Shimizu et al. | |
| 2014/0313266 | A1 | 10/2014 | Ishizawa et al. | |
| 2015/0085030 | A1 | 3/2015 | Shimizu et al. | |
| 2015/0124028 | A1 | 5/2015 | Kimura et al. | |
| 2015/0343789 | A1 | 12/2015 | Shimizu et al. | |
| 2016/0016408 | A1 | 1/2016 | Matsumoto et al. | |

FOREIGN PATENT DOCUMENTS

| | | |
|---|---|---|
| CN | 202278834 U | 6/2012 |
| JP | 2005-186590 | 7/2005 |
| JP | 2008-296508 | 12/2008 |
| JP | 2012-051307 | 3/2012 |
| JP | 2012-051328 | 3/2012 |
| JP | 2012-071581 | 4/2012 |
| JP | 2012-106363 | 6/2012 |

OTHER PUBLICATIONS

U.S. Appl. No. 14/593,881, filed Jan. 9, 2015, Kimura, et al.
U.S. Appl. No. 14/049,086, filed Oct. 8, 2013, Kimura, et al.
U.S. Appl. No. 14/049,086, Jun. 30, 2014, Office Action.
U.S. Appl. No. 14/049,086, Oct. 10, 2014, Final Office Action.
U.S. Appl. No. 14/049,086, Feb. 2, 2015, Notice of Allowance.
U.S. Appl. No. 14/593,881, Apr. 23, 2015, Office Action.
U.S. Appl. No. 14/593,881, Sep. 23, 2015, Final Office Action.
U.S. Appl. No. 14/593,881, Jan. 8, 2016, Office Action.
U.S. Appl. No. 14/737,008, Oct. 7, 2015, Office Action.
U.S. Appl. No. 14/737,008, Jan. 14, 2016, Final Office Action.

* cited by examiner

RECORDING APPARATUS

CROSS-REFERENCE TO RELATED APPLICATIONS

This application is a continuation of U.S. patent application Ser. No. 14/737,008, filed Jun. 11, 2015, which is a continuation application of U.S. patent application Ser. No. 14/593,881, filed Jan. 9, 2015, which is a continuation application of U.S. patent application Ser. No. 14/049,086, filed Oct. 8, 2013, all of which are incorporated herein by reference in their entirety. U.S. patent application Ser. No. 14/737,008 claims the benefit of and priority to Japanese Patent Application No. 2012-227712 filed Oct. 15, 2012, and Japanese Patent Application No. 2012-227713 filed Oct. 15, 2012, the contents of which are hereby incorporated by reference herein.

BACKGROUND OF THE INVENTION

1. Technical Field

The present invention relates to recording apparatuses.

2. Related Art

The recording apparatus disclosed in Chinese Utility Model Publication CN-U-202278834 is an example of a recording apparatus such as an ink jet printer. The recording apparatus disclosed in CN-U-202278834 includes a high-capacity main receptacle 131 within the apparatus, and ink is supplied from the main receptacle 131 to an ink cartridge 11 via a tube. An ink injection port is provided in an upper area of the main receptacle 131, and ink is supplied to the interior of the main receptacle 131 via the ink injection port.

In the recording apparatus disclosed in CN-U-202278834, there is nothing covering the ink injection port, and the ink injection port is provided so as to protrude outward to the exterior. Meanwhile, dust often accumulates on a top surface of the main receptacle 131 if the recording apparatus is left standing for long periods of time. In such a case, the dust will accumulate on top and in the periphery of the ink injection port. There are also situations where foreign objects aside from dust are present on top and in the periphery of the ink injection port. This leads to a problem in that dust, foreign objects, and the like will enter into the main receptacle 131 from the ink injection port. In this case, supplying ink to the ink cartridge has a risk in that a variety of malfunctions, such as clogging in a recording head, can occur.

Although employing a configuration in which the ink injection port is covered by an opening/closing member such as an upper cover member, a scanner unit, or the like located in an upper area of the apparatus can be considered, such a configuration has a problem in that it then becomes difficult to fill the ink through the ink injection port.

SUMMARY

It is an advantage of some aspects of the invention to provide a recording apparatus capable of preventing dust, foreign objects, and the like from entering into an ink tank while also making it possible to fill ink with ease.

A recording apparatus according to an aspect of the invention includes: a carriage, having a recording head that ejects ink, capable of moving in a predetermined direction; a housing body having an opening portion that exposes at least part of an upper area of a movement region of the carriage; an opening/closing member, attached to the housing body via a pivot shaft so as to be capable of pivoting freely, that covers the opening portion so as to overlap with the opening portion; and an ink tank that is disposed within the housing body, has an ink holding chamber that holds ink used in recording, and has an injection port for filling the ink holding chamber with the ink. Here, the ink tank is disposed so that one end thereof is positioned within the housing body on the opposite side of the housing body as the side in which the pivot shaft is provided; the ink tank has a stepped shape having a step portion in a position that is distanced from an end surface on the side of the ink tank located toward the opening/closing member, and the step portion is provided in the ink tank on the side thereof that is further from the pivot shaft; the injection port is provided in the step portion; and the injection port is exposed by pivoting the opening/closing member in a direction that opens the opening/closing member.

According to this configuration, the ink tank is disposed within the housing body and is covered by the opening/closing member that covers the opening portion of the housing body. Accordingly, when the ink tank is not being filled with ink, dust can be prevented from accumulating and foreign objects can be prevented from being present in the vicinity of the ink injection port by placing the opening/closing member in a closed state. Furthermore, the ink tank is disposed in a position within the housing body that is on the opposite side as the pivot shaft. Accordingly, in the case where the opening/closing member has been rotated in a direction that opens the opening/closing member and the ink tank is to be filled with ink, the portion of the opening/closing member that opposes the injection port can be opened to a greater angle, which in turn makes it possible to fill the ink with ease. Furthermore, because the step portion is provided on the side of the ink tank that is distanced from the pivot shaft, the portion of the opening/closing member that opposes the step portion can be opened to an even greater angle. In addition, the step portion provided in the ink tank is present in a position distanced from an end surface located toward the opening/closing member, and thus the injection port is positioned on the side that is distanced from the opening/closing member (for example, the lower side); thus when, for example, the ink is filled using the bottle that holds the ink, the bottle does not easily interfere with the opening/closing member.

According to another aspect of the invention, in the above aspect, it is preferable for the step portion to be provided facing an edge area of the housing body that is located away from the pivot shaft.

According to this configuration, the step portion is provided facing an edge area of the housing body that is located away from the pivot shaft, and thus when the ink is filled via the injection port, the bottle or the like can be inserted/removed from the edge area, and the bottle or the like can furthermore be positioned while protruding outward further than the edge area. This makes it possible to fill the ink even more easily.

Furthermore, a recording apparatus according to another aspect of the invention includes: a carriage, having a recording head that ejects ink, capable of moving in a predetermined direction; a housing body having an opening portion that exposes at least part of an upper area of a movement region of the carriage; an opening/closing member, attached to the housing body via a pivot shaft so as to be capable of pivoting freely, that covers the opening portion so as to overlap with the opening portion; an ink tank that is disposed within the housing body, has an ink holding chamber that holds ink used in recording, and has an injection port for filling the ink holding chamber with the ink; a flow channel that allows the ink to flow between the ink tank and the recording head; and a discharge port that discharges a recording medium that has been recorded onto by the recording head. Here, the ink tank is provided toward the discharge port; the ink tank has a stepped shape having a step portion in a position that is distanced from an end surface on the side of the ink tank located toward the opening/closing member, and the step portion is provided in the ink tank on the side thereof that is closer to the discharge port; the injection port is provided in the step portion; and the injection port is exposed by pivoting the opening/closing member in a direction that opens the opening/closing member.

According to this configuration, the ink tank is disposed within the housing body and is covered by the opening/closing member that covers the opening portion of the housing body. Accordingly, when the ink tank is not being filled with ink, dust can be prevented from accumulating and foreign objects can be prevented from being present in the vicinity of the ink injection port by placing the opening/closing member in a closed state. In addition, the ink tank is disposed toward the discharge port. This makes it possible to fill the ink with ease. Furthermore, the step portion is provided in the ink tank on the side thereof that is closer to the discharge port, and thus the ink can be filled with ease. In addition, the step portion provided in the ink tank is present in a position distanced from an end surface located toward the opening/closing member, and thus the injection port is positioned on the side that is distanced from the opening/closing member (for example, the lower side); thus when, for example, the ink is filled using the bottle that holds the ink, the bottle does not easily interfere with the opening/closing member.

According to another aspect of the invention, in the above aspect, it is preferable for the step portion to be provided facing an edge area of the housing body on the side thereof that is located toward the discharge port.

According to this configuration, the step portion is provided facing an edge area of the housing body that is closer to the discharge port, and thus when the ink is filled via the injection port, the bottle or the like can be inserted/removed from the edge area, and the bottle or the like can furthermore be positioned while protruding outward further than the edge area. This makes it possible to fill the ink even more easily.

Furthermore, a recording apparatus according to another aspect of the invention includes: a carriage, having a recording head that ejects ink, capable of moving in a predetermined direction; a housing body having an opening portion that exposes at least part of an upper area of a movement region of the carriage; an opening/closing member, attached to the housing body via a pivot shaft so as to be capable of pivoting freely, that covers the opening portion so as to overlap with the opening portion; an ink tank that is disposed within the housing body, has an ink holding chamber that holds ink used in recording, and has an injection port for filling the ink holding chamber with the ink; a flow channel that allows the ink to flow between the ink tank and the recording head; and a panel unit including an operation button for performing various types of operations. Here, the ink tank is provided toward the panel unit; the ink tank has a stepped shape having a step portion in a position that is distanced from an end surface on the side of the ink tank located toward the opening/closing member, and the step portion is provided in the ink tank on the side thereof that is closer to the panel unit; the injection port is provided in the step portion; and the injection port is exposed by pivoting the opening/closing member in a direction that opens the opening/closing member.

According to this configuration, the ink tank is disposed within the housing body and is covered by the opening/closing member that covers the opening portion of the housing body is covered. Accordingly, when the ink tank is not being filled with ink, dust can be prevented from accumulating and foreign objects can be prevented from being present in the vicinity of the ink injection port by placing the opening/closing member in a closed state. In addition, the ink tank is disposed toward the panel unit. This makes it possible to fill the ink with ease. Furthermore, the step portion is provided in the ink tank on the side thereof that is closer to the panel unit, and thus the ink can be filled with ease. In addition, the step portion provided in the ink tank is present in a position distanced from an end surface located toward the opening/closing member, and thus the injection port is positioned on the side that is distanced from the opening/closing member (for example, the lower side); thus when, for example, the ink is filled using the bottle that holds the ink, the bottle does not easily interfere with the opening/closing member.

According to another aspect of the invention, in the above aspect, it is preferable for the step portion to be provided facing an edge area of the housing body on the side thereof that is located toward the panel unit.

According to this configuration, the step portion is provided facing an edge area of the housing body that is closer to the panel unit, and thus when the ink is filled via the injection port, the bottle or the like can be inserted/removed from that edge area, and the bottle or the like can furthermore be positioned while protruding outward further than the edge area. This makes it possible to fill the ink even more easily.

According to another aspect of the invention, in the above aspect, it is preferable for the recording head having nozzles that eject the ink supplied from a plurality of the ink tanks to be provided so as to move in the main scanning direction, and for the plurality of ink tanks to be disposed so as to be arranged in the main scanning direction.

According to this configuration, the plurality of ink tanks are disposed so as to be arranged in the main scanning direction, and thus the injection ports of all of the ink tanks are provided in the edge area of the housing body or toward the discharge port or toward the panel unit in the housing body, on the opposite side as the pivot shaft of the opening/closing member. Accordingly, the ease of operations when filling the ink can be improved even more.

According to another aspect of the invention, in the above aspect, it is preferable for a cover that can be opened/closed relative to the housing body and encloses the periphery of the ink tank to be provided in the housing body, in a location thereof that is further from the pivot shaft than the ink tank.

According to this configuration, the cover is opened/closed relative to the housing body, and thus the ease of operations when filling the ink tank with ink can be improved even more.

According to another aspect of the invention, in the above aspect, it is preferable for the plurality of ink tanks to have an ink tank positioned toward a corner portion of the housing body, for the cover to have a first side surface that extends in the main scanning direction and a second side surface that extends in a direction that intersects with the main scanning direction and for the cover to span across the corner portion of the housing body due to the first side surface and the second side surface, and for the cover to be provided extending further toward the opening/closing member than the injection port.

According to this configuration, the cover that includes the first side surface portion and the second side surface portion has an L-shaped exterior form when viewed from above. Accordingly, when the cover is opened, the second side surface portion of the cover moves away from a corner portion of the housing body. Through this, the cover can be prevented from interfering with the filling of ink despite the ink tank that is to be filled with ink being positioned at the corner portion, which makes it possible to improve the ease of operations when filling the ink.

According to another aspect of the invention, in the above aspect, it is preferable for the opening/closing member to be held in an open position relative to the housing body by a support member, for the injection port to be linked to a bottle for filling the ink when the ink tank is to be filled with ink, and in the case where the bottle has been linked to the injection port, for the opening/closing member to be held by the support member in the open position where the opening/closing member does not interfere with the bottle.

According to this configuration, when the opening/closing member is opened, the open position of the opening/closing member is held by the support member. Furthermore, the opening/closing member is held by the support member in an open position in which the opening/closing member does not interfere with the bottle. Accordingly, the ease of operations when linking the bottle to the injection port and filling the ink tank with ink can be improved even more.

BRIEF DESCRIPTION OF THE DRAWINGS

The invention will be described with reference to the accompanying drawings, wherein like numbers reference like elements.

FIG. 6A is a diagram illustrating a position of a lever during an open state, whereas

DESCRIPTION OF EXEMPLARY EMBODIMENTS

Hereinafter, a recording apparatus 10 according to an embodiment of the invention will be described with reference to the drawings. Note that XYZ axes that are mutually orthogonal are indicated in the following drawings as necessary in order to specify directions, and the XYZ axes are indicated as necessary in other drawings as well. Here, in FIG. 1 and the like, the direction of an arrow X1 corresponds to "right", the direction of an arrow X2 corresponds to "left", the direction of an arrow Y1, which is a direction orthogonal to the X direction and is a direction in which recording paper (a type a recording medium) is discharged, corresponds to "front", the direction of an arrow Y2 corresponds to "rear", the direction of an arrow Z1 that is orthogonal to the XY plane corresponds to "top", and the direction of an arrow Z2 corresponds to "bottom".

Configuration of Recording Apparatus 10

Figure 1:
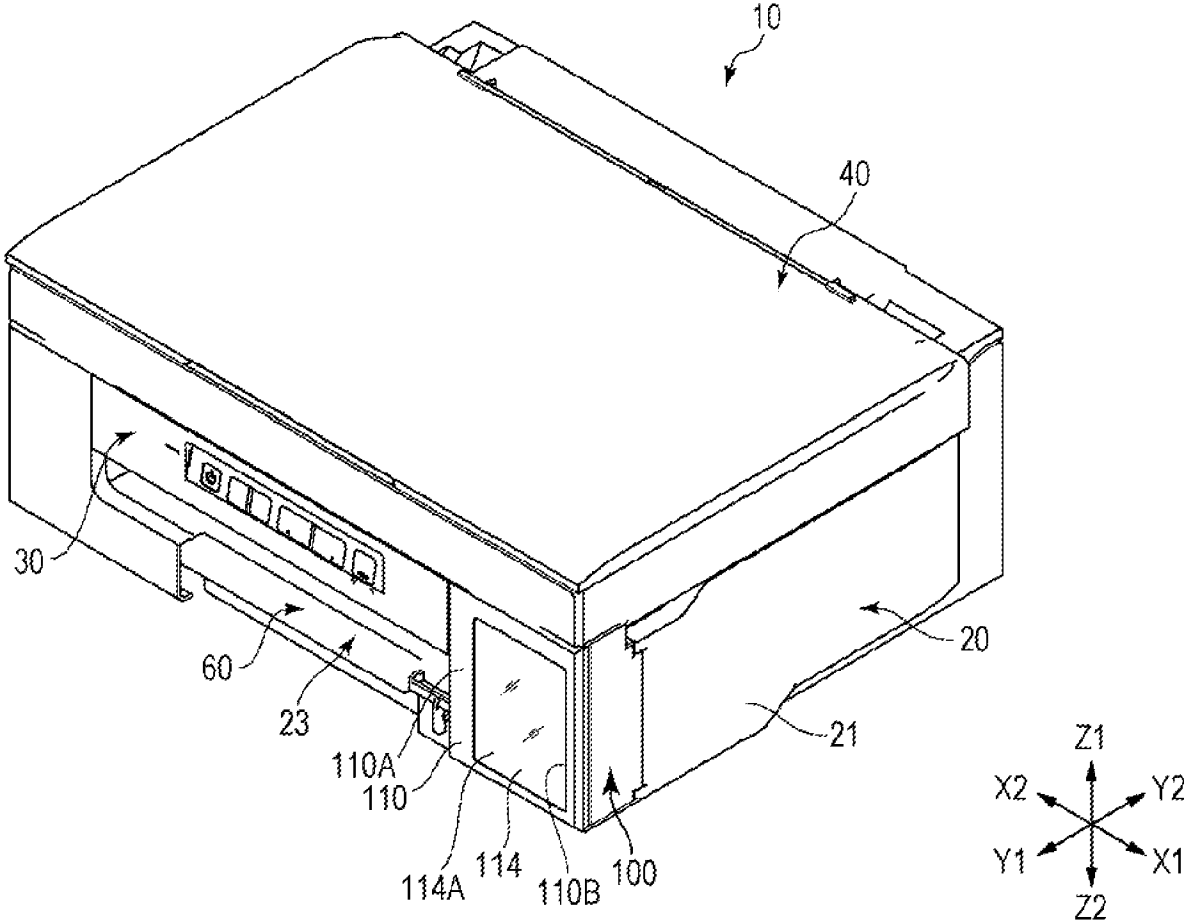
FIG. 1 is a perspective view illustrating a recording apparatus in which an opening/closing member is closed.
Figure 2:
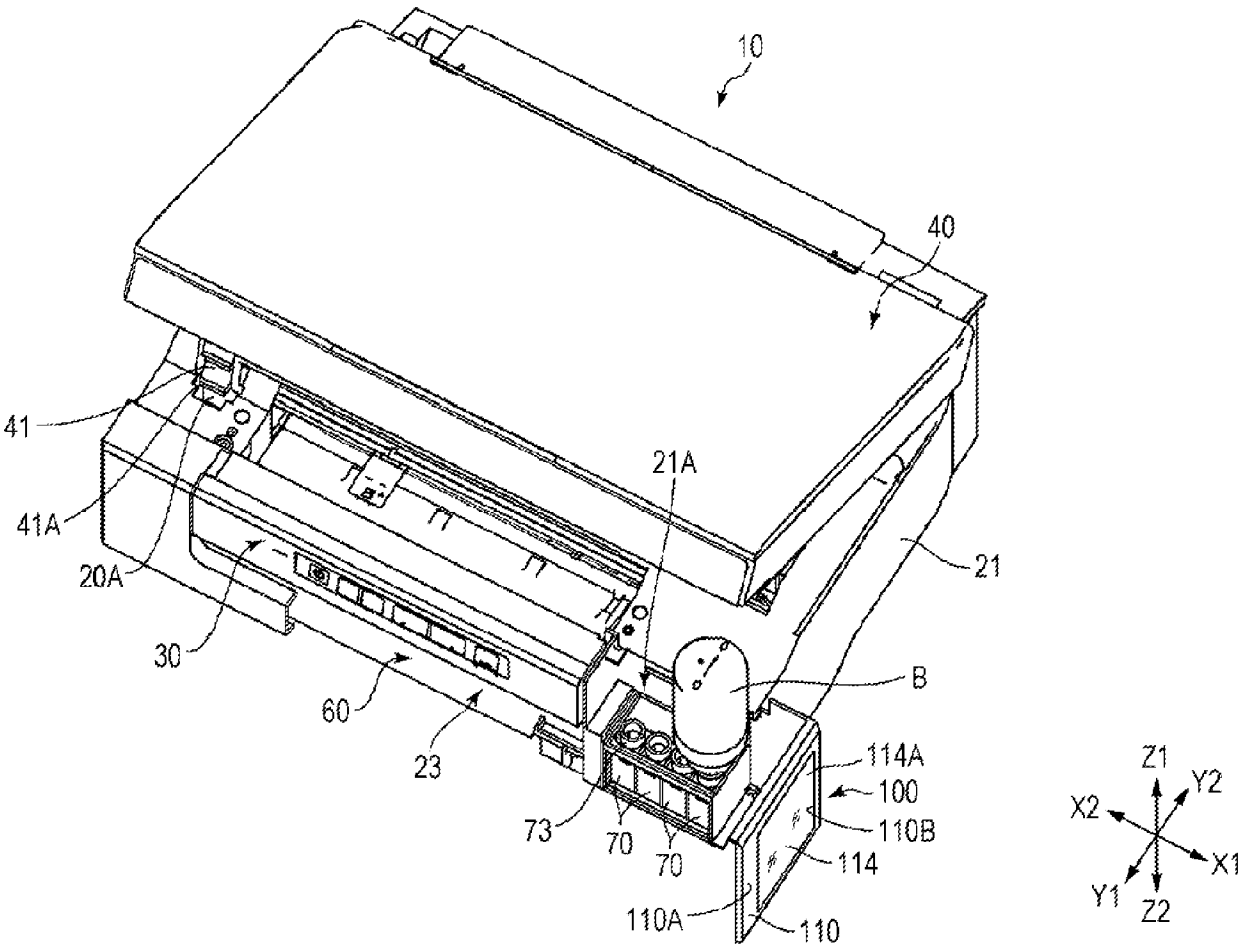
FIG. 2 is a perspective view illustrating a recording apparatus in which an opening/closing member is open.

FIG. 1 is a perspective view of the recording apparatus 10 according to an embodiment of the invention, and illustrates a state in which an opening/closing member 40 is closed. FIG. 2, meanwhile, is a perspective view of the recording apparatus 10 illustrating a state in which the opening/closing member 40 is open.

As shown in FIGS. 1 and 2, the recording apparatus 10 is provided with a housing body 20 that includes an outer panel 21. The outer panel 21 is provided on an outer area of the housing body 20. Note that as shown in FIG. 2, a corner portion of the outer panel 21 on the front (Y1) side (in FIG. 2, a corner portion on the right (X1) side) is cut out, resulting in a cutout portion 21A, and a cover 110, which will be mentioned later, is mounted in this cutout portion 21A. A panel unit 30 is attached to the housing body 20. The panel unit 30 is provided in the housing body 20 so as to be capable of pivoting, with a pivot shaft (not shown) serving as a fulcrum. However, a configuration in which the panel unit 30 does not pivot relative to the housing body 20 may be employed.

As shown in FIG. 2, the opening/closing member 40 is attached to the housing body 20, via a pivot shaft (not shown), so as to be capable of opening/closing. The pivot shaft is provided on a rear (Y2) side of the housing body 20. In the configuration shown in FIG. 2, the opening/closing member 40 corresponds to, for example, a scanner unit having a function for reading an original document. However, the opening/closing member 40 is not limited to a scanner unit, and may be a cover member or another type of member. The opening/closing member 40 is provided so as to cover an upper end surface (that is, the surface on one end) of the housing body 20.

Figure 3:
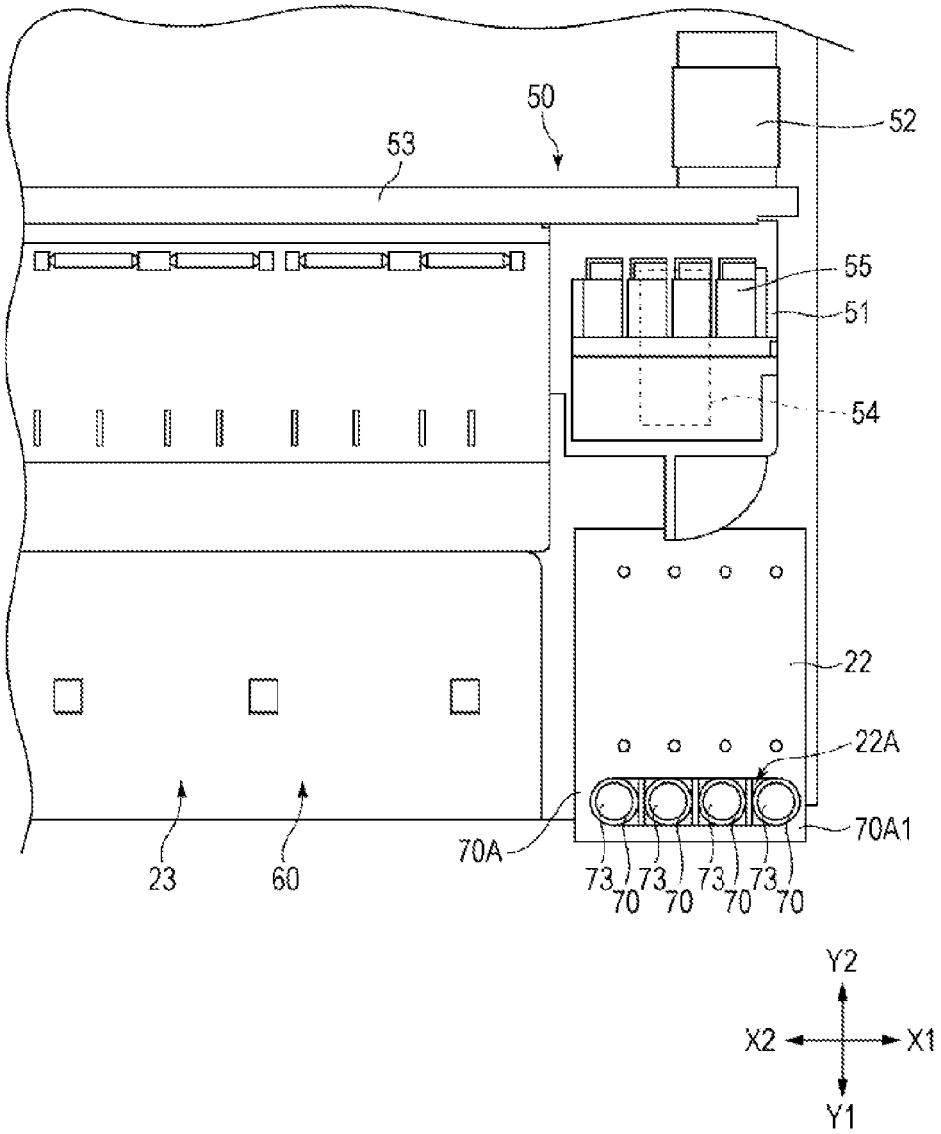
FIG. 3 is a plan view illustrating a carriage mechanism and an attachment member of a recording apparatus.

FIG. 3 is a plan view illustrating a carriage mechanism 50 and an attachment member 22 to which ink tanks 70 are attached, in the recording apparatus 10. As shown in FIG. 3, the carriage mechanism 50, which includes a carriage 51, is provided within the housing body 20. The carriage 51 is capable of moving in a main scanning direction (corresponding to the X direction) along a sliding guide member 53, when driven by a carriage motor 52. A recording head 54 is attached to a side of the carriage 51 that opposes a transport path; recording images can be formed on recording paper by ejecting ink from nozzles provided in the recording head 54.

Meanwhile, sub tanks 55 for holding ink supplied to the recording head 54 are provided in the carriage 51. Ink is supplied to the sub tanks 55 from the ink tanks 70 (described later) via a tube assembly 80 (see FIG. 4). However, it is also possible to employ a configuration that omits the sub tanks 55, and in such a case, temporary ink holding units that receive the ink supplied from the ink tanks 70 and then supply the ink to the recording head 54 may be provided instead of the sub tanks 55. Alternatively, the ink may be supplied directly to the recording head 54 from the ink tanks 70 via the tube assembly 80, without providing the sub tanks 55, the temporary ink holding units, or the like.

A stacker 60 is provided in the housing body 20. The stacker 60 is provided spanning from a side of the housing body 20 on which a discharge port 23 from which the recording paper is discharged is located (a front side; a Y1 side) to the rear (Y2) side within the housing body 20. The stacker 60 is a unit that holds the recording paper (not shown) in a stacked state after recording images have been formed on the recording paper by the recording head 54 and the recording paper has been discharged. Note that a pull-out tray for assisting in supporting the recording paper may be provided in the stacker 60, in a retractable state, in order to hold the recording paper in a more favorable manner.

As shown in FIG. 2, in the case where the opening/closing member 40 is released from the housing body 20, the opening/closing member 40 is supported by a support member 41. The support member 41 is provided so as to be storable within the housing body 20 through a hole portion 20A of the housing body 20.

Incidentally, positioning the support member 41 closer to the rear (Y2) side rather than positioning the support member 41 closer to the front (Y1) side reduces the length required for the support member 41 to support the opening/closing member 40 when the opening/closing member 40 is open. Accordingly, it is preferable for the support member 41 to be positioned as far rearward (toward the Y2 side) as possible, but it is also necessary to provide the support member 41 in a position where the support member 41 does not interfere with the carriage 51. Therefore, the support member 41 is positioned further toward the front (toward the Y1 side) than a scanning region of the carriage 51 when the support member 41 is stored within the housing body 20.

Note, however, that it is preferable for the support member 41 to be positioned significantly further toward the rear (toward the Y2 side) than the front (Y1) side of the outer panel 21 of the housing body 20. Specifically, it is preferable for the support member 41 to be positioned further toward the rear (toward the Y2 side) than the panel unit 30, and to be positioned further toward the rear (toward the Y2 side) than the center of the ink tanks 70 in the Y direction.

As shown in FIG. 2, a hook portion 41A is provided in the support member 41. The hook portion 41A is a portion for hooking onto an edge area of the hole portion 20A, and a single or a plurality of hook portions 41A (two, in FIG. 2) are provided along a direction in which the support member 41 extends, enabling the angle at which the opening/closing member 40 is opened to be adjusted in steps corresponding to the number of hook portions 41A. The open state of the opening/closing member 40 can be maintained by hooking the hook portion 41A onto the edge area of the hole portion 20A. In order to enable this hooking action, the hook portion 41A protrudes from an end surface of the support member 41, and an engagement portion positioned on an edge area of the hole portion 20A is present below the protruding hook portion 41A. Note that the support member 41 is biased by a spring, and the direction of bias brings a lower end side of the support member 41 toward the front (toward the Y1 side). Ink Tanks 70 and Attachment Structure Thereof Next, the ink tanks 70 will be described. As shown in FIGS. 2 and 3, the ink tanks 70 are provided within the housing body 20. The ink tanks 70 are portions that hold ink, and the ink is supplied toward the recording head 54 from the ink tanks 70. A number of ink tanks 70 corresponding to a number of ink types used in recording are provided, and the plurality of ink tanks 70 are provided so as to be arranged in the main scanning direction (the X direction).

Note that in the configuration illustrated in FIGS. 2 and 3, four types of ink, namely black, cyan, magenta, and yellow, are held in respective ink tanks 70. However, the ink is not limited to four types, and any number of types may be used; in such a case, the same number of ink tanks 70 as there are ink types are provided.

As shown in FIGS. 2 and 3, the ink tanks 70 are attached via the attachment member 22 to an area of the housing body 20 that is between the stacker 60 and the outer panel 21.

Figure 4:
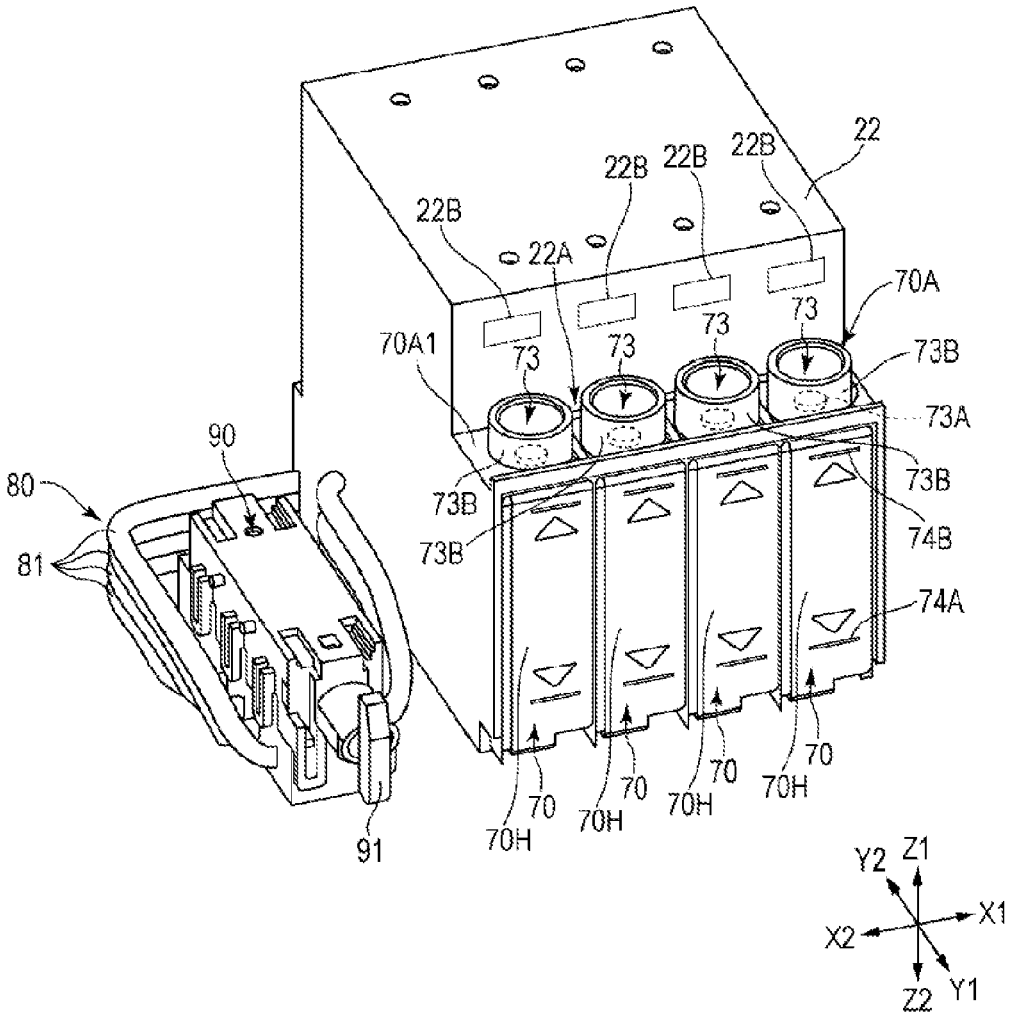
FIG. 4 is a perspective view illustrating an attachment member and a choke valve mechanism.

FIG. 4 is a perspective view illustrating the attachment member 22 to which the ink tanks 70 are attached and a choke valve mechanism 90. The attachment member 22 is provided so as to cover the set of the four ink tanks 70, and a cutout portion 22A (see FIG. 3) is provided in the attachment member 22 so as to expose injection ports 73, which will be mentioned later. Note that like the ink tanks 70, the attachment member 22 is provided having a stepped shape with two steps, and the stated cutout portion 22A is provided in an end surface 70A1 of the lower stepped area (a lower step 70A).

Meanwhile, as shown in FIG. 2, the ink tanks 70 are disposed in an area of the housing body 20 that is on the opposite side as the side where the support member 41 is provided, with the stacker 60 located therebetween (disposed further toward the X1 side than the stacker 60). In FIG. 2, the support member 41 is provided on the left (X2) side of the housing body 20, and the ink tanks 70 are provided on the right (X1) side of the housing body 20.

Figure 5:
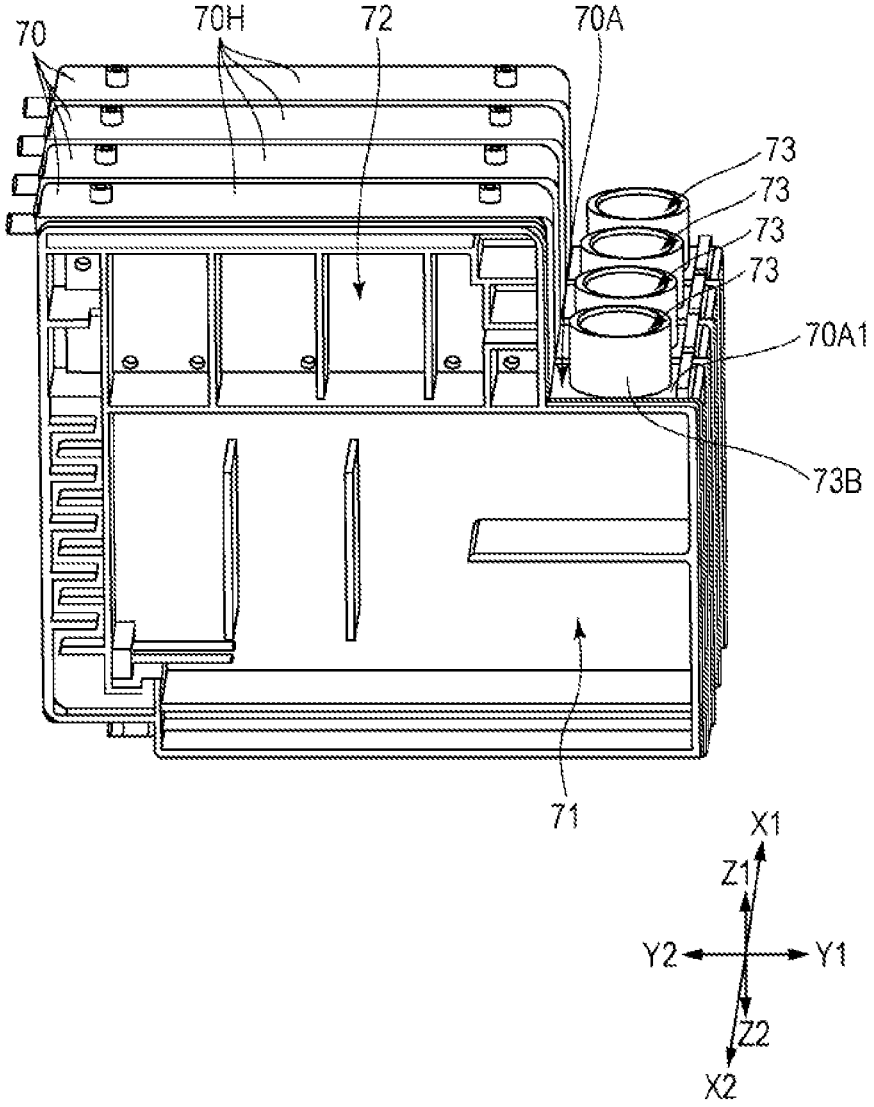
FIG. 5 is a perspective view illustrating the configuration of ink tanks.

FIG. 5 is a perspective view illustrating the configuration of the ink tanks 70. Note that in FIG. 5, of the ink tanks 70, the ink tank 70 positioned on the X2 side is illustrated with an outer surface area on the X2 side of a housing 70H cut away in order to show the internal configuration of the ink tanks 70. Each ink tank 70 includes an ink holding chamber 71 that holds ink therein and an air chamber 72, and the ink holding chamber 71 and the air chamber 72 are covered by the housing 70H. The housing 70H of the ink tank 70 is provided having a stepped shape with two steps, in the configuration shown in FIG. 5. Of these, the lower stepped area (the lower step 70A) is positioned toward the front (Y1) side of the housing body 20.

The injection port 73 is provided in the end surface 70A1 on the upper side of the lower step 70A (this corresponds to an end surface on the side toward the opening/closing member 40). The injection port 73 is a portion for filling (injecting) the ink holding chamber 71 with ink held in a bottle B (see FIG. 2) or the like. The injection port 73 has an opening 73A that penetrates the end surface 70A1, and also has an outer peripheral flange portion 73B that covers the opening 73A. By providing the injection port 73 with the outer peripheral flange portion 73B in addition to the opening 73A, the ink can be filled with ease using the bottle B. Note that although an area of the outer peripheral flange portion 73B that is furthest toward the front (Y1) side is provided so as to be in close proximity with a side surface of the housing 70H on the front side thereof, the area of the outer peripheral flange portion 73B that is furthest toward the front (Y1) side may be provided flush with the side surface of the housing 70H on the front side thereof.

Note that the lower step 70A corresponds to a step portion. In this embodiment, the lower step 70A is provided in a surface of an edge area of the ink tank 70 that is further from the pivot shaft. Meanwhile, the ink tank 70 may be provided having a stepped shape with three or more steps. In this case, the injection port 73 may be provided in any step portion as long as it is a step portion that is lower than the end surface 70A1 on the upper side. In addition, although the lower step 70A is provided in the edge area toward the front (Y1) side of the ink tank 70, the end surface 70A1 on the upper side may be present to the front or rear of the lower step 70A as long as the end surface 70A1 is further toward the front (Y1) side than the center of the ink tank 70 in the depth direction (the Y direction).

As shown in FIG. 4, markers 74A and 74B are provided on a side surface of the housing 70H, on the front (Y1) side thereof. The markers 74A and 74B serve as indicators for measuring the amount of ink remaining in the ink holding chamber 71. The markers 74A and 74B include a marker 74A that indicates a lower limit of the remaining amount of ink and a marker 74B that indicates an upper limit of the remaining amount of ink. A user can confirm that it has become necessary to fill the ink when the remaining amount of ink has dropped below the marker 74A. Meanwhile, the user can confirm that the ink has been filled to capacity when the remaining amount of ink has reached the marker 74B when filling the ink. Here, the marker 74A that indicates the lower limit on the remaining amount of ink corresponds to a "lower limit indicator". Rather than a configuration in which the marker 74A that corresponds to the lower limit indicator is present on the ink tank 70, the configuration may be such that the marker 74A is provided on a transparent member 114A of the cover 110, which will be mentioned later.

Note that each of the ink tanks 70 holds a different type of ink. Accordingly, it is preferable to provide a means that prevents the ink tanks 70 from being filled with the wrong type of ink. To that end, type information 22B indicating the type of ink to be held in the respective ink tanks 70 is provided on the attachment member 22, as shown in FIG. 4.

One end side of the tube assembly 80 shown in FIG. 4 is connected to the ink tanks 70 in order to supply ink from the ink tanks 70 toward the sub tanks 55 in the carriage 51. The choke valve mechanism 90 is provided partway along the tube assembly 80. The tube assembly 80 includes a plurality of tubes 81 for distributing the ink, and the tubes 81 extend so as to link the ink tanks 70 with corresponding sub tanks 55. In this embodiment, there are four types of ink, namely black, cyan, magenta, and yellow, and thus four tubes 81 are also provided to configure the tube assembly 80. Internal flow channels (not shown) for distributing the ink are provided individually within the four tubes 81. Note that the tubes 81 correspond to "flow channels".

The choke valve mechanism 90 shown in FIG. 4 is a mechanism for squeezing the plurality of tubes 81 in the tube assembly 80 and cutting off the internal flow channels therein. The flow of ink from the ink tanks 70 to the sub tanks 55 is stopped as a result of this cutoff, and the ink is prevented from spilling, flowing in reverse, or the like even if the recording apparatus 10 is tilted or the like during transport. The choke valve mechanism 90 is provided between the ink tanks 70 and the stacker 60. The choke valve mechanism 90 includes a lever 91, and the lever 91 is linked to a cam (not shown).

Figure 6A:
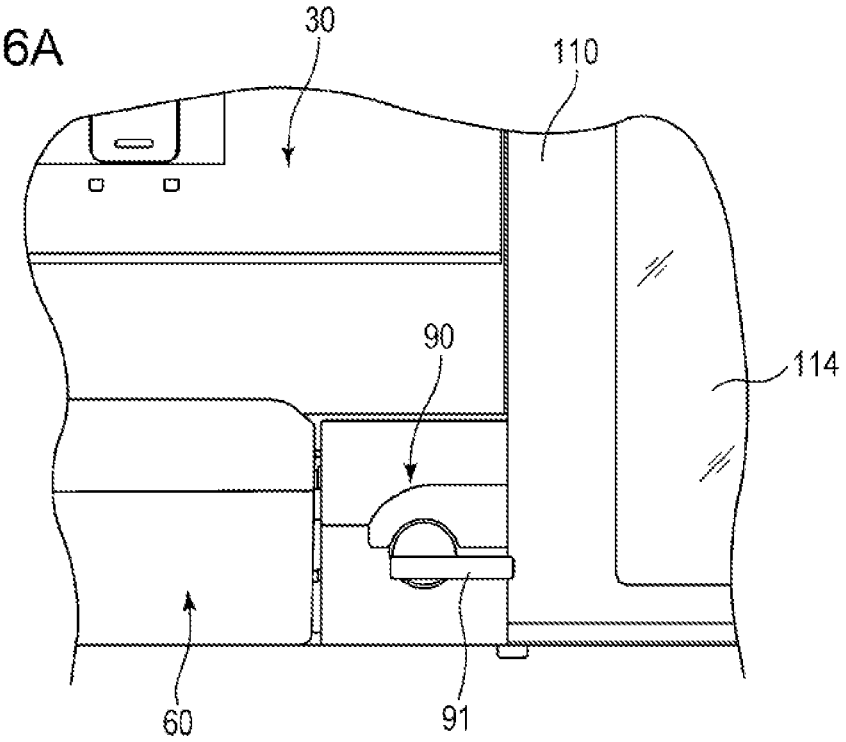
Figure 6B:
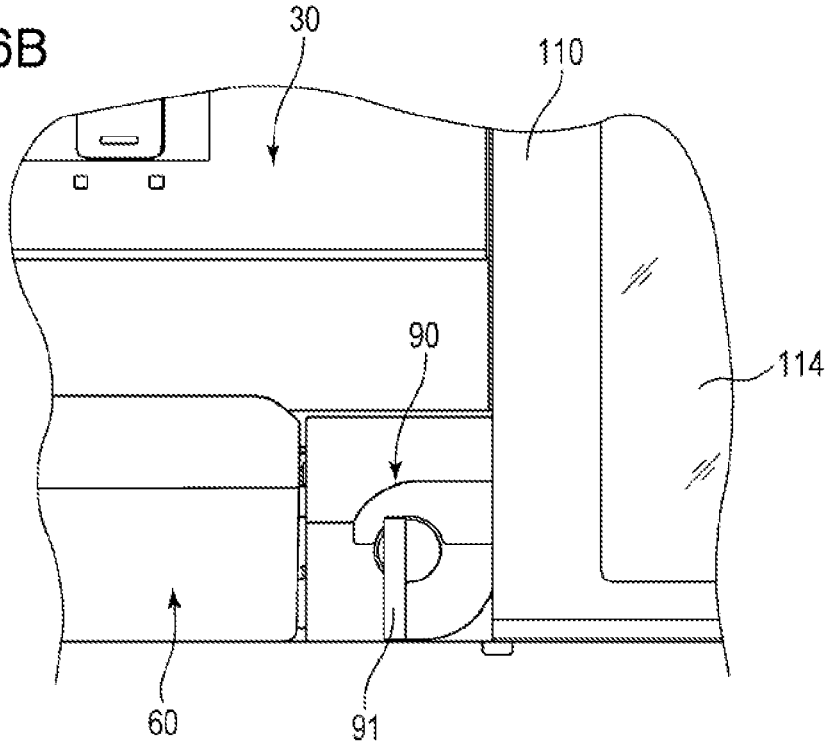
FIG. 6B is a diagram illustrating a position of the lever during a blocked state.

FIGS. 6A and 6B are diagrams illustrating rotation positions of the lever 91 in the choke valve mechanism 90, where FIG. 6A illustrates a position of the lever 91 when the internal flow channels are in an open state and FIG. 6B illustrates a position of the lever 91 when the internal flow channels are in a blocked state. When the lever 91 is in the rotational position shown in FIG. 6A, the tubes 81 are open, and the ink can flow within the internal flow channels in the tubes 81. When the lever 91 is then rotated 90 degrees and set to the rotational position of the lever 91 shown in FIG. 6B, the plurality of tubes 81 that configure the tube assembly 80 are squeezed simultaneously and the flow of ink is stopped. The internal flow channels in the tubes 81 can be blocked and opened by rotating the lever 91 in this manner.

Cover Opening/Closing Mechanism 100

Next, a cover opening/closing mechanism 100 will be described. As shown in FIGS. 1 and 2, the cover opening/closing mechanism 100 includes the cover 110, and is a mechanism for opening/closing the cover 110 relative to the housing body 20. As shown in FIG. 2, the cover 110 is mounted in the cutout portion 21A cut out from the corner portion of the outer panel 21 of the housing body 20 on the front (Y1) right (X1) side thereof. In the case where the cover 110 is opened and the opening/closing member 40 is kept in an opened state, the ink tanks 70 can be filled with ink from the bottle B via the injection ports 73. The cover 110 is put in a closed state in the case where the ink tanks 70 are not to be filled with ink from the bottle B.

Figure 7:
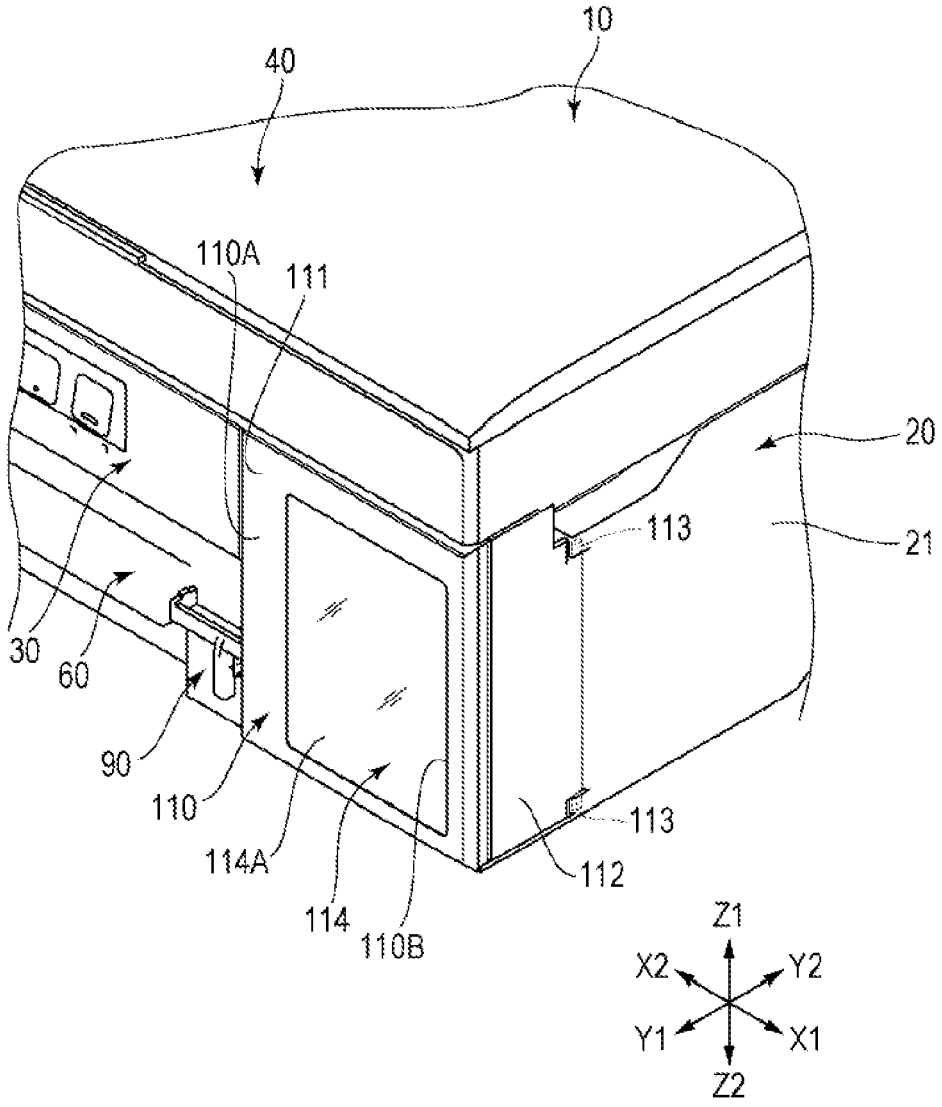
FIG. 7 is a perspective view illustrating the vicinity of a cover of a recording apparatus in an enlarged manner.

FIG. 7 is a perspective view illustrating the vicinity of the cover 110 of the recording apparatus 10 in an enlarged manner. Note that although this specification assumes the cover 110 is not included in the housing body 20, the cover 110 may be included in the housing body 20.

The cover 110 has an L-shaped form when viewed from above in a closed state. In order to achieve this L-shaped form, the cover 110 includes a first side surface portion 111 and a second side surface portion 112, and the first side surface portion 111 and the second side surface portion 112 are connected with edge areas thereof being orthogonal to each other. In addition, when the cover 110 is closed, the first side surface portion 111 extends so as to follow the main scanning direction (the X direction) and the second side surface portion 112 extends so as to follow a sub scanning direction (the Y direction).

A pivot shaft 113 is provided in the cover 110. In the configuration shown in FIG. 7, the pivot shaft 113 is provided so as to protrude vertically from top and bottom edges of the second side surface portion 112 on the rear (Y2) side thereof. A shaft hole (not shown) is provided in an area that opposes the housing body 20 in order to support the pivot shaft 113, and the pivot shaft 113 is supported by the shaft hole so as to be capable of freely rotating.

As shown in FIG. 7, a viewing window 114 configured of the transparent member 114A is provided in the cover 110. The viewing window 114 is, as shown in FIG. 7, provided in the first side surface portion 111, and is configured as described hereinafter. A rectangular hole section 110B is provided in an area of the first side surface portion 111, aside from the viewing window 114, that is configured of a material such as an opaque resin (this area will be referred to as an opaque section 110A), and the viewing window 114 is configured by embedding the transparent member 114A in the hole section 110B. However, the cover 110 may be formed through two-color formation of the opaque section 110A and the transparent member 114A.

In this manner, providing the viewing window 114 configured from the transparent member 114A in the cover 110 makes it possible for the user to visually confirm the amount of ink remaining in the ink tanks 70 through the viewing window 114.

Note that the cover 110 is not limited to the type shown in FIGS. 1, 2, and 7. The types shown in FIGS. 8 to 12 are examples of other types of the cover 110. With the type of the cover 110 shown in FIG. 8, the viewing window 114 is provided so as to span the first side surface portion 111 and the second side surface portion 112. That is, the hole section 110B is provided continuously across both the first side surface portion 111 and the second side surface portion 112, and the viewing window 114 is configured by embedding the transparent member 114A in that continuous hole section 110B.

Figure 9:
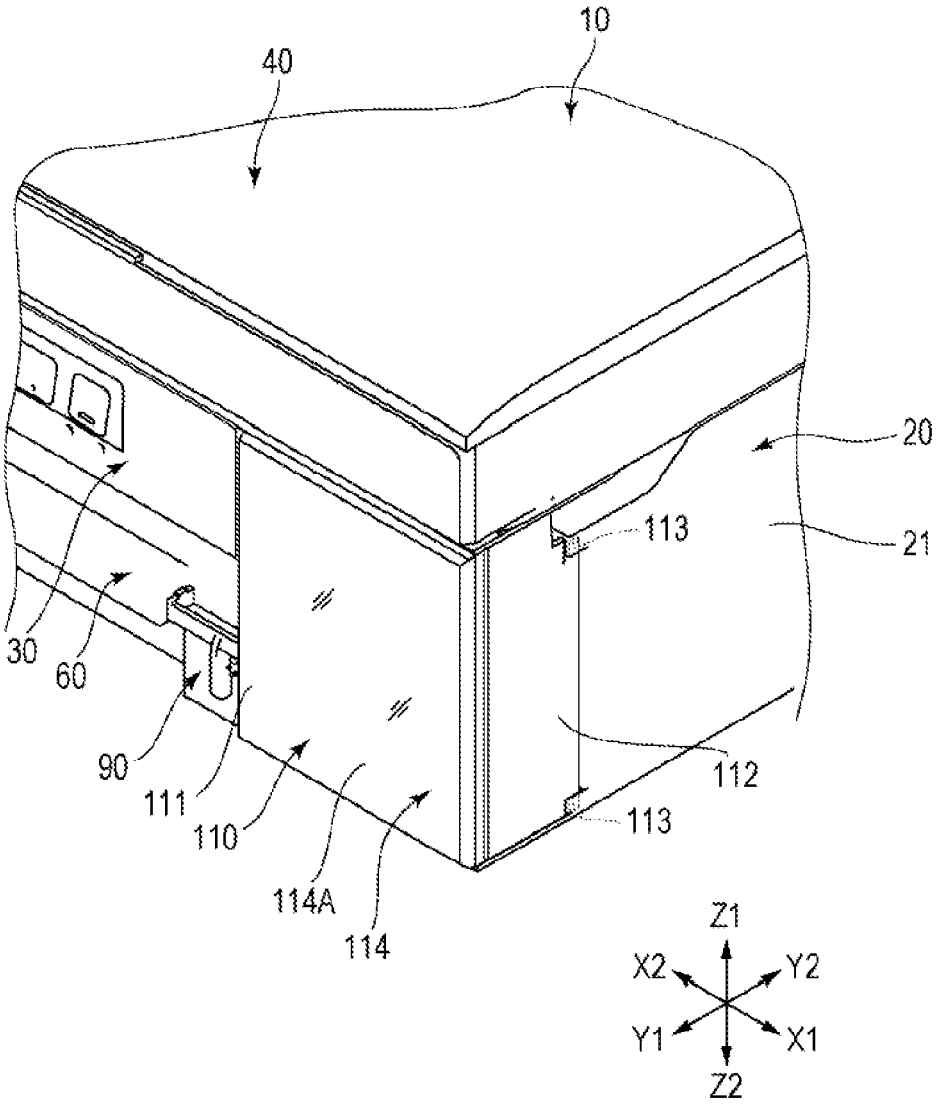
FIG. 9 is a perspective view illustrating the vicinity of another type of cover in an enlarged manner.

With the type of the cover 110 shown in FIG. 9, the entire cover 110 is formed of the transparent member 114A. With this type of the cover 110, the entire cover 110 functions as the viewing window 114.

Figure 10:
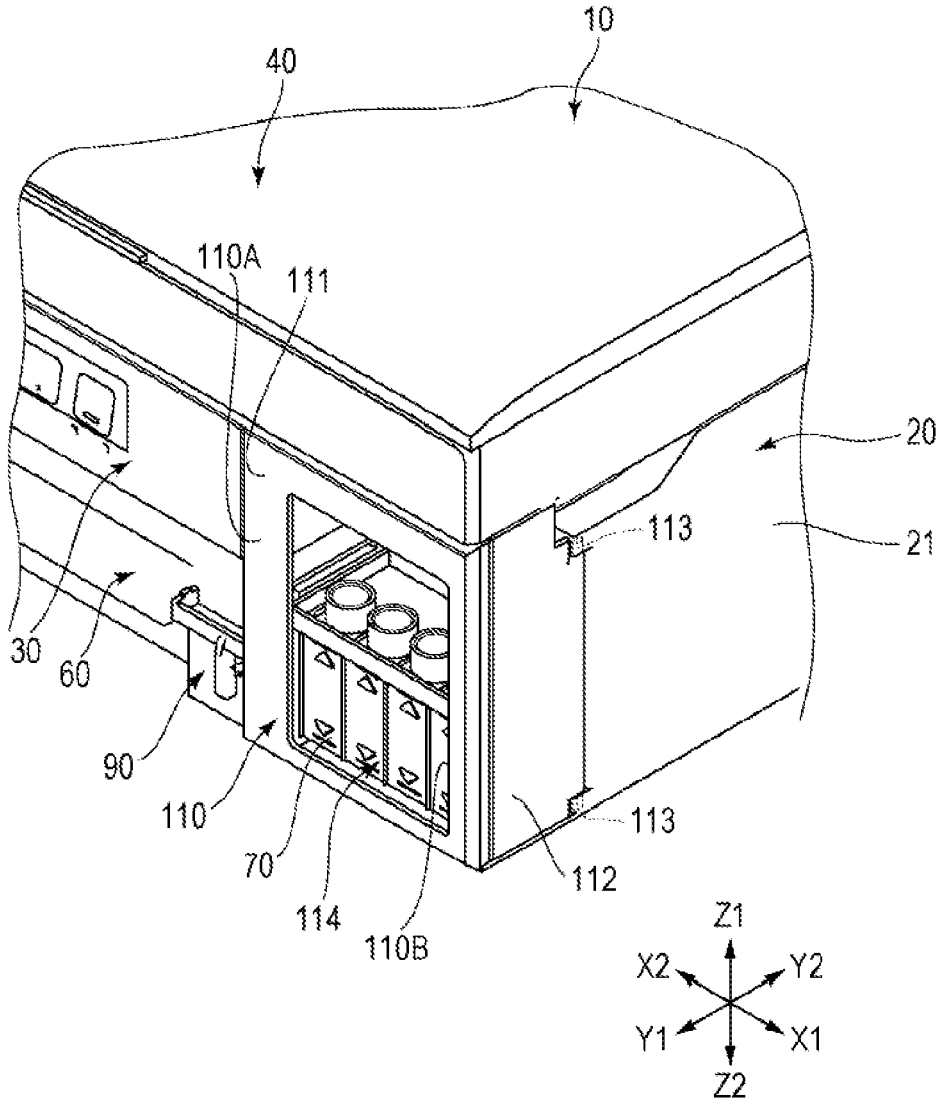
FIG. 10 is a perspective view illustrating the vicinity of another type of cover in an enlarged manner.

With the type of the cover 110 shown in FIG. 10, the configuration is such that the hole section 110B is provided in the opaque section 110A of the first side surface portion 111, but the transparent member 114A is not provided in the hole section 110B.

Figure 11:
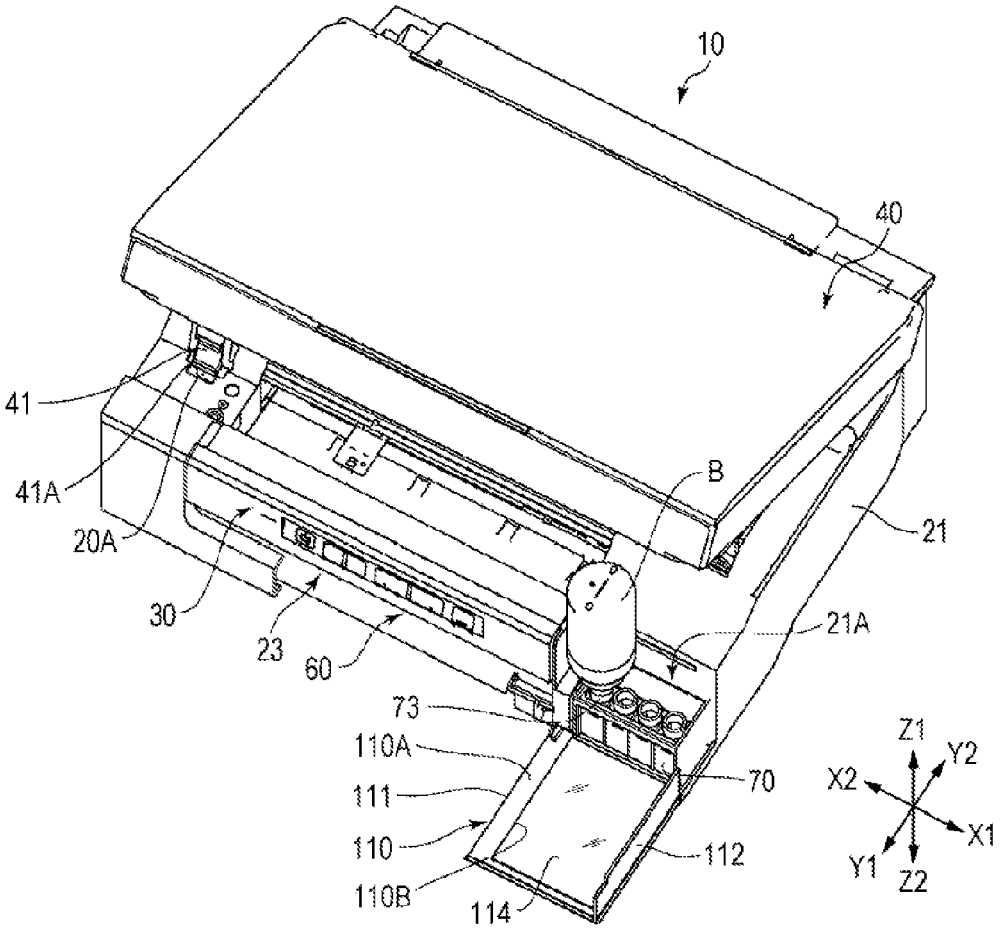
FIG. 11 is a perspective view illustrating a recording apparatus in which another type of cover is open.

It is also possible to change the position where the pivot shaft 113 is attached in the types of the cover 110 shown in the aforementioned FIGS. 7 to 10. FIG. 11 is a diagram illustrating a forward-tilting type cover 110. In the following descriptions, the covers 110 illustrated in FIGS. 7 to 10 will be referred to as side-opening type covers 110 as necessary.

With the forward-tilting type cover 110 shown in FIG. 11, a pivot shaft (not shown in FIG. 11; the same pivot shaft as the pivot shaft 113) is provided so as to protrude horizontally (in the X direction) from edge areas of a bottom (Z2) side of the first side surface portion 111. A shaft hole (not shown) is provided in an area that opposes a lower side of the housing body 20 in order to support the pivot shaft, and the pivot shaft is supported by the shaft hole so as to be capable of freely rotating.

Figure 8:
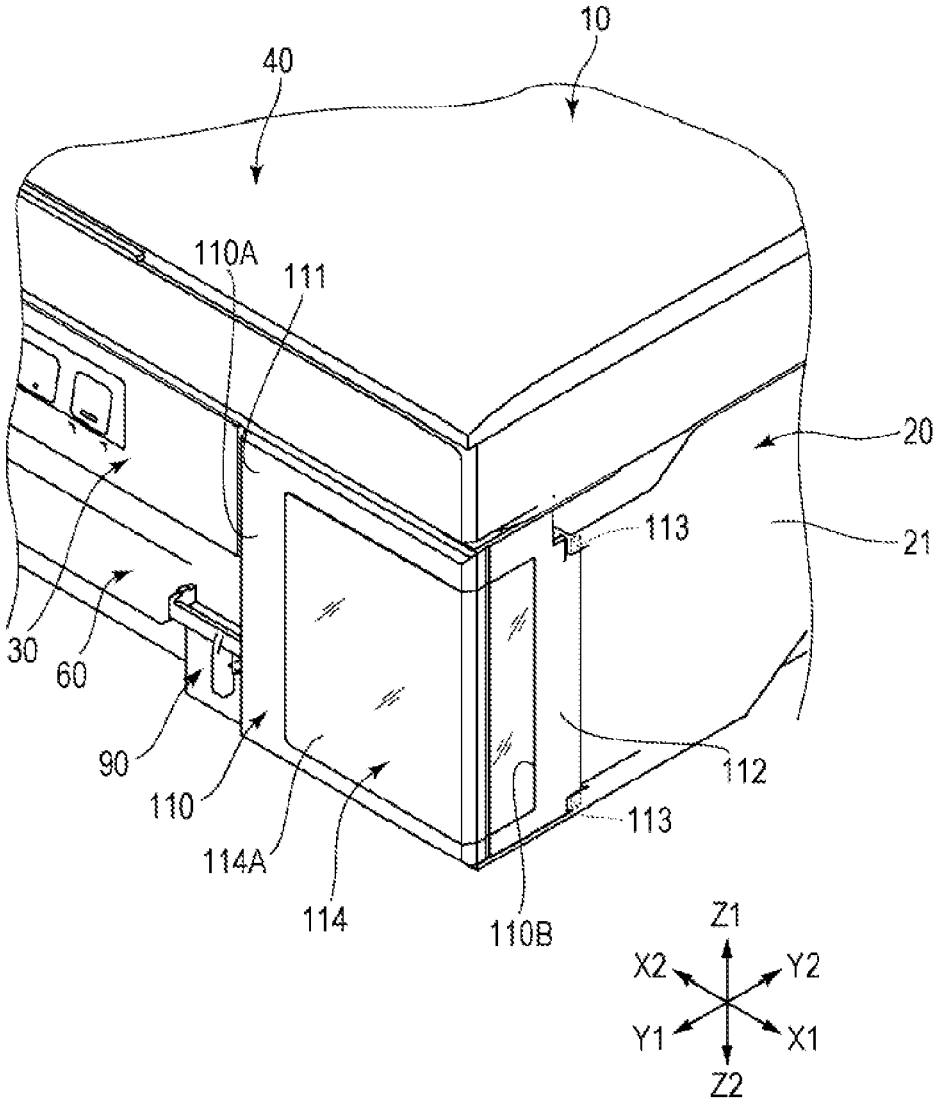
FIG. 8 is a perspective view illustrating the vicinity of another type of cover in an enlarged manner.

Note that although the cover 110 shown in FIG. 11 includes the same type of viewing window 114 as that shown in FIG. 7, the types of the cover 110 shown in FIGS. 8 to 10 can of course be changed from the side-opening type to the forward-tilting type.

Figure 12:
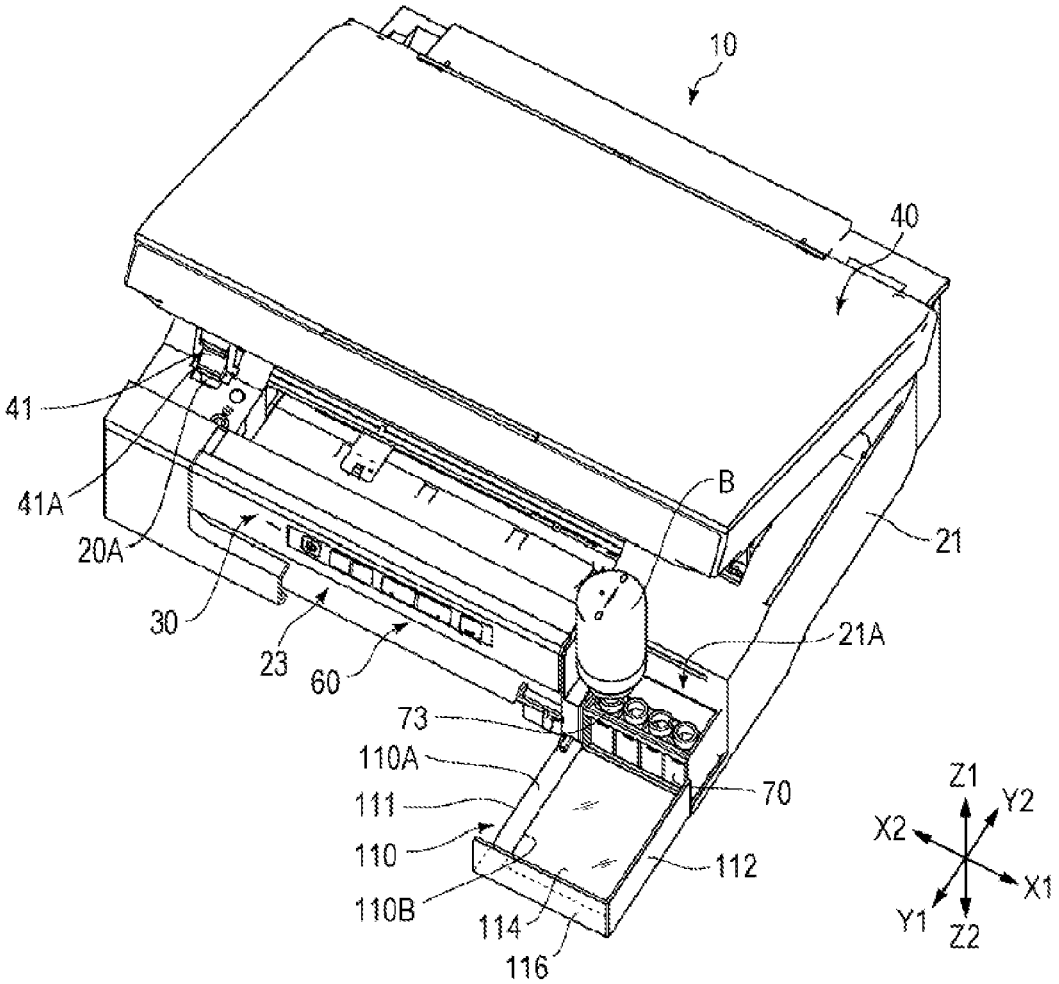
FIG. 12 is a perspective view illustrating a recording apparatus in which another type of cover is open.

Meanwhile, the types of the cover 110 illustrated in the aforementioned FIGS. 7 to 11 can also employ a configuration that includes a dust-resistant side surface portion 116, as shown in FIG. 12, in addition to the first side surface portion 111 and the second side surface portion 112. The dust-resistant side surface portion 116 is a portion that covers the injection ports 73 when the cover 110 is closed relative to the housing body 20. Through this, when the cover 110 is closed, the injection ports 73 are covered by the dust-resistant side surface portion 116, and thus dust, foreign objects, and the like can be prevented from adhering to the injection ports 73 even outside ink filling periods when ink is not being filled. The dust-resistant side surface portion 116 is provided so as to be orthogonal to the first side surface portion 111 and the second side surface portion 112. Note that the dust-resistant side surface portion 116 may be provided continuously, orthogonal to an edge area of the first side surface portion 111 and an edge area of the second side surface portion 112.

Note that the dust-resistant side surface portion 116 may be provided in a position as described hereinafter. The dust-resistant side surface portion 116 may be provided so as to make contact with the injection ports 73 when the cover 110 is closed, or may be provided in a position in which the dust-resistant side surface portion 116 does not make contact with the injection ports 73 but is closer to the injection ports 73 than in the configuration shown in FIG. 12. In the case where such a configuration is employed, the injection ports 73 are covered by the dust-resistant side surface portion 116 that is in a closer position, and thus dust, foreign objects, and the like can be even more effectively prevented from adhering to the injection ports 73 even outside ink filling periods when ink is not being filled.

Figure 13:
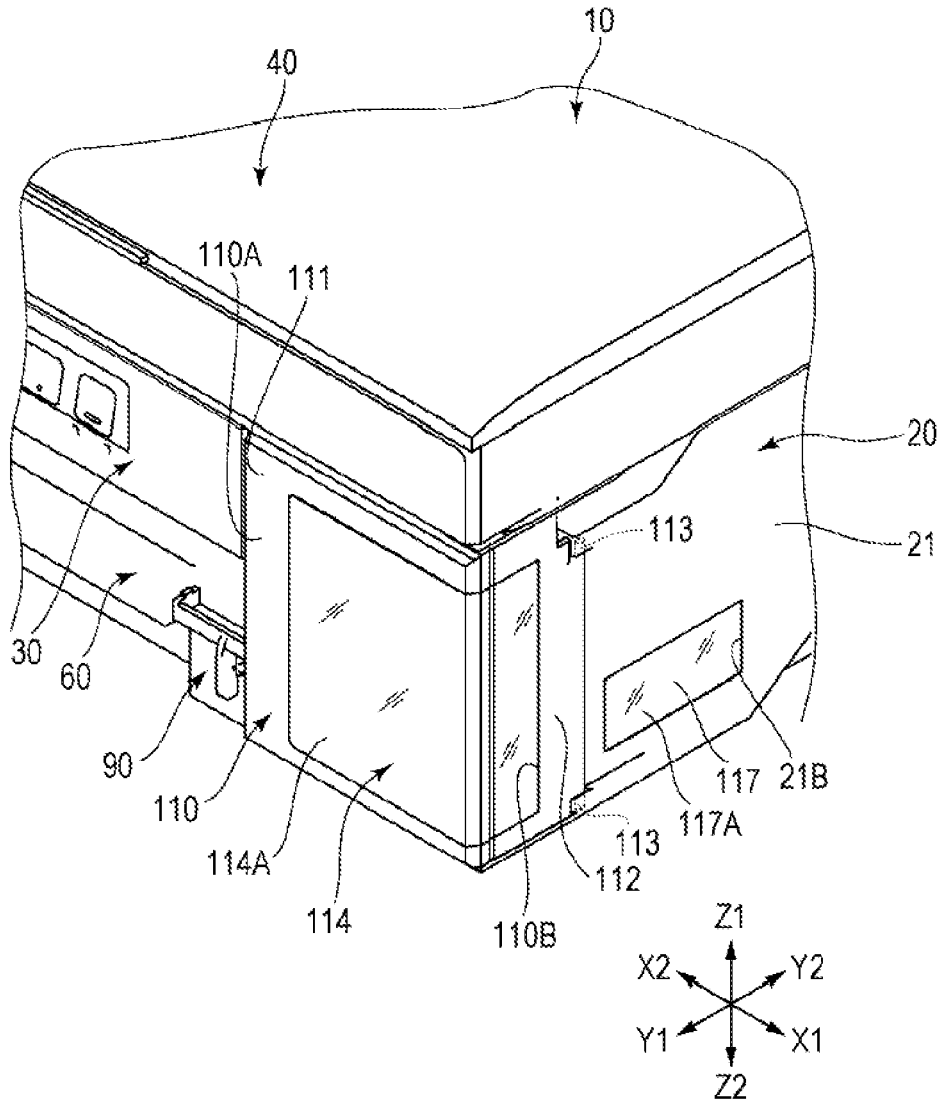
FIG. 13 is a perspective view illustrating the vicinity of another type of cover in an enlarged manner.

Meanwhile, a viewing window 117 may be provided in the outer panel 21 of the housing body 20, as shown in FIG. 13, in addition to in the cover 110. FIG. 13 is a diagram illustrating a configuration in which the viewing window 117 is provided in the outer panel 21 in addition to the viewing window 114 provided in the cover 110. The viewing window 117 is configured by providing a rectangular viewing hole 21B in the outer panel 21 and embedding a transparent member 117A in the viewing hole 21B. However, the viewing window 117 is provided having a smaller surface area than the viewing window 114, and is furthermore provided so that an upper end thereof is lower than an upper end of the viewing window 114 and a lower end thereof is higher than a lower end of the viewing window 114.

The amounts of ink remaining in the ink tanks 70 can be visually confirmed through this viewing window 117 as well. However, the viewing window 117, which has a small surface area as mentioned above, also serves to emphasize the high-capacity ink tanks 70 as a facet of the external appearance, and thus need not provide a function for visually confirming that it has become necessary to fill the ink.

Operations when Filling Ink Tanks 70 with Ink

Operations carried out in the recording apparatus 10 configured as described above when filling the ink tanks 70 with ink will be described below.

First, prior to filling the ink, the opening/closing member 40 is opened as illustrated in FIG. 2, and the hook portion 41A of the support member 41 is hooked onto an edge area of the hole portion 20A. As a result, the opening/closing member 40 is kept in an open state, and opening the opening/closing member 40 in this manner secures the space required for filling the ink tanks 70 with ink from the bottle B through the injection ports 73.

Furthermore, the cover 110 is opened before or after the opening/closing member 40 is opened. When the cover 110 is opened, an upper end area of the cover 110 moves away from the ink tanks 70. As a result, the bottle B does not interfere with the cover 110 when the ink is being filled.

When the opening/closing member 40 and the cover 110 are open, a tapered spout of the bottle B is inserted into the injection ports 73 of the ink tanks 70. The ink holding chambers 71 of the ink tanks 70 are filled with the ink by, for example, pressurizing the bottle B in this state. When the ink tanks 70 have been filled to a predetermined level, the spout of the bottle B is pulled out from the injection ports 73, and the ink filling process ends.

Effects

According to the recording apparatus 10 configured as described above, the ink tanks 70 are disposed within the housing body 20, and are covered by the opening/closing member 40, which covers the upper sides of the ink tanks 70. Accordingly, when the ink tanks 70 are not being filled with ink, dust can be prevented from accumulating and foreign objects can be prevented from being present in the vicinity of the injection ports 73 by placing the opening/closing member 40 in a closed state. Furthermore, the ink tanks 70 are disposed in a position within the housing body 20 that is on the opposite side as the pivot shaft (the front side; the Y1 side). Accordingly, in the case where the opening/closing member 40 has been rotated in a direction that opens the opening/closing member and the ink tanks 70 are to be filled with ink, the portion of the opening/closing member 40 that opposes the injection ports 73 can be opened to a greater angle, which in turn makes it possible to fill the ink with ease.

Furthermore, because the lower steps 70A are provided on the sides of the ink tanks 70 that are distanced from the pivot shaft (the front side; the Y1 side), the portion of the opening/closing member 40 that opposes the lower steps 70A can be opened to an even greater angle. In addition, the lower step 70A is present in a position on the lower (Z2) side, distanced from the end surface 70A1 located toward the opening/closing member 40. Accordingly, the injection ports 73 are positioned on the lower (Z2) side, distanced from the opening/closing member 40, and thus when, for example, the ink is filled using the bottle B that holds the ink, the bottle B does not easily interfere with the opening/closing member 40.

Note that the lower steps 70A are provided on the side of the ink tanks 70 located toward the discharge port 23 (or toward the panel unit 30), and thus the ink can be filled with ease.

Meanwhile, the lower steps 70A are provided facing an edge area of the housing body 20 on the side located toward the discharge port 23 (or toward the panel unit 30). Accordingly, when the ink is filled via the injection ports 73, the bottle B or the like can be inserted/removed from an edge area of the housing body 20, and the bottle B or the like can furthermore be positioned while protruding outward further than the edge area. This makes it possible to fill the ink even more easily.

In addition, in this embodiment, the lower steps 70A are positioned on an edge area side of the ink tanks 70 that is distanced from the pivot shaft (that is, an edge area on the front (Y1) side). Accordingly, when the ink is filled via the injection ports 73, the bottle B or the like can be inserted/removed from an edge area on the front side, and the bottle B or the like can furthermore be positioned while protruding outward further than the edge area on the front side. This makes it possible to fill the ink even more easily.

Furthermore, in this embodiment, the plurality of ink tanks 70 are disposed so as to be arranged in the main scanning direction, and thus the injection ports 73 of all of the ink tanks 70 are provided in an area toward the edge of the housing body 20 on the opposite side as the pivot shaft of the opening/closing member 40 (that is, an area toward the front (Y1) side). Accordingly, the ease of operations when filling the ink can be improved even more.

In addition, in this embodiment, the configuration is such that cover 110 is opened/closed relative to the housing body 20. Accordingly, the ease of operations when filling the ink tanks 70 with ink can be improved even more.

Furthermore, in this embodiment, the cover 110 that includes the first side surface portion 111 and the second side surface portion 112 has an L-shaped exterior form when viewed from above. Accordingly, when the cover 110 is opened, the second side surface portion 112 of the cover 110 moves away from a corner portion of the housing body 20. Through this, the cover 110 can be prevented from interfering with the filling of ink despite the ink tanks 70 that are to be filled with ink being positioned at the corner portion, which makes it possible to improve the ease of operations when filling the ink.

In addition, in this embodiment, when the opening/closing member 40 is opened, the open position of the opening/closing member 40 is held by the support member 41. Furthermore, the opening/closing member 40 is held by the support member 41 in an open position in which the opening/closing member 40 does not interfere with the bottle B. Accordingly, the ease of operations when linking the bottle B to the injection ports 73 and filling the ink tanks 70 with ink can be improved even more.

Note that in this embodiment, when the opening/closing member 40 is opened, the open position of the opening/closing member 40 is maintained by the support member 41, and a space for injecting the ink is formed as a result. Accordingly, the ease of operations when filling the ink tanks 70 with ink can be improved even more.

Furthermore, in this embodiment, the support member 41 is provided in the housing body 20 on the opposite side as the side on which the ink tanks 70 are provided, with the stacker 60 located therebetween. Accordingly, the support member 41 can be prevented from interfering with the ink tanks 70 even when the support member 41 is stored within the housing body 20. Through this, the freedom of the layout, namely the area where the support member 41 is provided, can be increased.

Furthermore, in this embodiment, the support member 41 is not provided in the scanning region in which the carriage 51 slides, and thus the support member 41 does not interfere with the carriage 51. In addition, the support member 41 is provided toward the carriage 51 and distanced from the outer panel 21 located on the front (Y1) side, and thus the length of the support member 41 required to hold the opening/closing member 40 in an open state can be reduced.

Variations

The foregoing describes an embodiment of the invention, but it should be noted that many variations on the invention can be made. Such variations will be described hereinafter.

Variation 1

The aforementioned embodiment describes a case in which a plurality of ink tanks 70 are provided, one for each type of ink. However, an integrated ink tank, in which a plurality of types of ink are held in a single ink tank, may be provided instead. In this case, the ink tank includes the same number of ink holding chambers as there are types of ink, and includes the same number of injection ports as there are ink holding chambers. According to this configuration as well, when the ink tanks 70 are not being filled with ink, dust can be prevented from accumulating and foreign objects can be prevented from being present in the vicinity of the injection ports by placing the opening/closing member 40 and the cover 110 in a closed state.

Variation 2

In the aforementioned embodiment, the plurality of ink tanks 70 are disposed so as to be arranged in the main scanning direction (the X direction). However, the plurality of ink tanks may instead be disposed so as to be arranged in the sub scanning direction (the Y direction), the vertical direction (Z direction), or the like. According to this configuration as well, when the ink tanks 70 are not being filled with ink, dust can be prevented from accumulating and foreign objects can be prevented from being present in the vicinity of the injection ports by placing the opening/closing member and the cover 110 in a closed state.

Variation 3

In the aforembodiment, the injection ports 73 are provided in the end surfaces 70A1 on the upper sides of the lower steps 70A in the ink tanks 70. However, the injection ports may be provided in side surfaces of the ink tanks, on the front (Y1) sides thereof. According to this configuration as well, when the ink tanks 70 are not being filled with ink, dust can be prevented from accumulating and foreign objects can be prevented from being present in the vicinity of the injection ports by placing the opening/closing member 40 and the cover 110 in a closed state.

Variation 4

In the aforementioned embodiment, the ink tanks 70 are disposed in an area of the housing body 20 that is on the opposite side as the side where the support member 41 is provided, with the stacker 60 located therebetween. However, a configuration in which the ink tanks are provided in the housing body 20 on the same side as the support member 41 relative to the stacker 60 may be employed. Note, however, that in this case, it is necessary to employ a configuration in which the support member 41 does not interfere with the ink tanks 70.

Variation 5

A removable member such as an ink cartridge may be included in the concept of the ink tanks 70 described in the aforementioned embodiment. This is because as long as the ink cartridge includes injection ports, such an ink cartridge can improve the ease of operations when filling the ink, in the same manner as the invention according to the aforementioned embodiment.

Variation 6

In the aforementioned embodiment, the cover 110 has an L-shaped form when viewed from above. However, the shape of the cover is not limited to an L-shaped form when viewed from above. For example, a variety of other shapes can be employed for the cover, such as a straight shape when viewed from above.

Variation 7

The aforementioned embodiment describes the cover 110 as being a side-opening type, as shown in FIG. 2, or a forward-tilting type, as shown in FIG. 11. However, the cover is not limited to these types, and other types may be employed instead. A sliding type, in which the cover is slid in at least one of the main scanning direction (the X direction), the sub scanning direction (the Y direction), and the vertical direction (the Z direction), can be given as an example of another type of cover.

What is claimed is:

1. A recording apparatus comprising:

a carriage which includes a recording head performing a recording on a medium and is movable in movement area of the predetermined direction;

a carriage drive motor which drives the carriage;

a housing body including the carriage;

a bulge portion that bulges from a side surface of the housing body;

a transportation path that transports the medium to a discharge port;

an ink tank that is disposed within the housing body and includes an injection port for filling the ink;

a cover that can be opened/closed relative to the housing body, wherein the ink tank is disposed on an opposite side of the housing body as a side in which the pivot shaft is provided;

wherein the ink tank is positioned outside the transportation path in the moving direction of the carriage;

wherein a part of the tank is positioned outside the carriage driving motor, wherein a side surface of the cover and the bulge portion lie in the same plane, when the cover is in a closed state.

2. The recording apparatus according to claim 1, wherein the part of the tank is located outside the carriage movement area.

3. The recording apparatus according to claim 1, wherein the injection ports are located inside the front surface of the housing.

4. The recording apparatus according to claim 1, wherein the cover is projected from the discharge port.

5. A recording apparatus comprising:

a carriage which includes a recording head performing a recording on a medium and is movable in movement area of the predetermined direction;

a scanner attached to the housing body via a pivot shaft so as to be capable of pivoting freely; and an ink tank that is disposed within the housing body and includes an injection port for filling the ink, wherein the ink tank is disposed on an opposite side of the housing body as a side in which the pivot shaft is provided;

the injection port is provided in a location other than an upper surface of the ink tank;

a cover that can be opened/closed relative to the housing body and covering the injection port; and wherein the injection port is exposed by opening the scanner and the cover.

6. The recording apparatus according to claim 5, wherein the part of the tank is located outside the carriage movement area.

7. The recording apparatus according to claim 5, wherein the injection ports are located inside the front surface of the housing.

8. A recording apparatus comprising:

a carriage which includes a recording head performing a recording on a medium and is movable in movement area of the predetermined direction;

a housing body including the carriage;

a bulge portion that bulges from a side surface of the housing body;

a cover that can be opened/closed relative to the housing body;

a panel unit including an operation button for performing various types of operations, the panel unit being disposed in the front portion of the housing body;

an ink tank that is disposed in the housing body, and includes a plurality of the injection ports for refilling the ink within the ink tank, and the ink tank is located adjacent to the panel unit, and wherein the injection ports are arranged parallel to the carriage moving direction, and are located below the lower end of the panel unit, wherein a side surface of the cover and the bulge portion lie in the same plane, when the cover is in a closed state.

9. The recording apparatus according to claim 8, wherein the part of the tank is located outside the carriage movement area.

10. The recording apparatus according to claim 8, wherein the injection ports are located inside the front surface of the housing.

* * * * *